US011455861B2

(12) United States Patent
Huke et al.

(10) Patent No.: US 11,455,861 B2
(45) Date of Patent: Sep. 27, 2022

(54) METHOD OF DETERMINING IF A SINGLE PLAY BET IS TOO RISKY

(71) Applicant: AdrenalineIP, Washington, DC (US)

(72) Inventors: Casey Alexander Huke, Washington, DC (US); John Cronin, Jericho, VT (US); Joseph W. Beyers, Saratoga, CA (US); Michael D'Andrea, Burlington, VT (US); Harrison Grant, Anaheim, CA (US)

(73) Assignee: AdrenalineIP, Washington, DC (US)

( * ) Notice: Subject to any disclaimer, the term of this patent is extended or adjusted under 35 U.S.C. 154(b) by 0 days.

(21) Appl. No.: 16/952,406

(22) Filed: Nov. 19, 2020

(65) Prior Publication Data

US 2022/0139149 A1 May 5, 2022

Related U.S. Application Data

(60) Provisional application No. 63/109,975, filed on Nov. 5, 2020.

(51) Int. Cl.
*G07F 17/32* (2006.01)

(52) U.S. Cl.
CPC ..... *G07F 17/323* (2013.01); *G07F 17/3288* (2013.01)

(58) Field of Classification Search
CPC ..... G07F 17/323; G07F 17/3288
See application file for complete search history.

(56) References Cited

U.S. PATENT DOCUMENTS

| | | | | |
|---|---|---|---|---|
| 10,210,703 | B2 | 2/2019 | Merati | |
| 2005/0124410 | A1* | 6/2005 | Vlazny | G06Q 50/34 463/28 |
| 2006/0094506 | A1* | 5/2006 | Tarter | G06Q 10/00 463/42 |
| 2013/0178270 | A1 | 7/2013 | Flaherty et al. | |
| 2020/0098228 | A1 | 3/2020 | Amaitis et al. | |
| 2020/0111325 | A1* | 4/2020 | Lockton | G07F 17/3211 |
| 2020/0126363 | A1* | 4/2020 | Trepp | G07F 17/3288 |
| 2020/0265667 | A1 | 8/2020 | Amaitis et al. | |

OTHER PUBLICATIONS

Notification of Transmittal of the International Search Report and the Written Opinion of the International Searching Authority dated Dec. 7, 2021, in connection with corresponding international Application No. PCT/US2021/058225; 10 pgs.

* cited by examiner

*Primary Examiner* — Yingchuan Zhang
(74) *Attorney, Agent, or Firm* — Maier & Maier, PLLC

(57) ABSTRACT

A system for wagering on outcomes of a live sporting event during the event wherein the odds users are given for a wager are generated based on historical data and then adjusted based on risk factors. These risk factors include lack of sufficient data to form an accurate odds assessment, a wide range of odds from similar plays, and overall monetary loss within a set time frame. Each factor is analyzed individually and then amalgamated into one adjustment factor which is then used to adjust the odds. In this way the system accounts for its own level of inaccuracy in calculating odds.

6 Claims, 3 Drawing Sheets range risk module Object Content

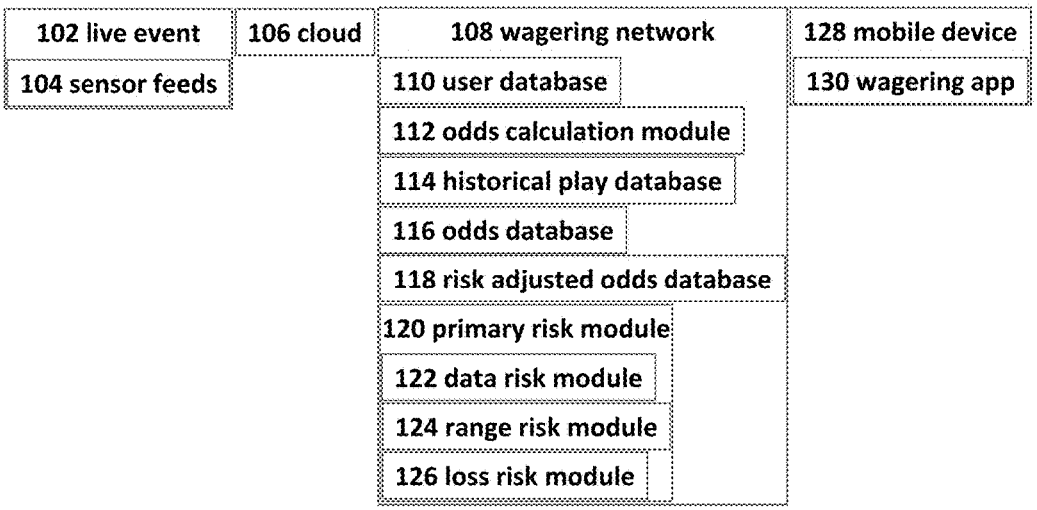
Fig.1 Content - High Level Diagram
| Original | Ajusted | Play | Players | Time of Adjustment |
|---|---|---|---|---|
| 1 to 2 | 1 to 1.8 | 1 | Dak Prescott, CeeDee Lamb, Ezekiel Elliot, ... | 08:43:22 PM 10/27/2020 |
| 1 to 3 | 1 to 2.5 | 2 | Dak Prescott, CeeDee Lamb, Ezekiel Elliot, ... | 08:45:53 PM 10/27/2020 |
| 1 to 1 | 1 to 0.9 | 3 | Dak Prescott, CeeDee Lamb, Ezekiel Elliot, ... | 08:47:14 PM 10/27/2020 |
| - | - | - | - | - |
| - | - | - | - | - |
Fig.2 risk adjusted odds database Data Content

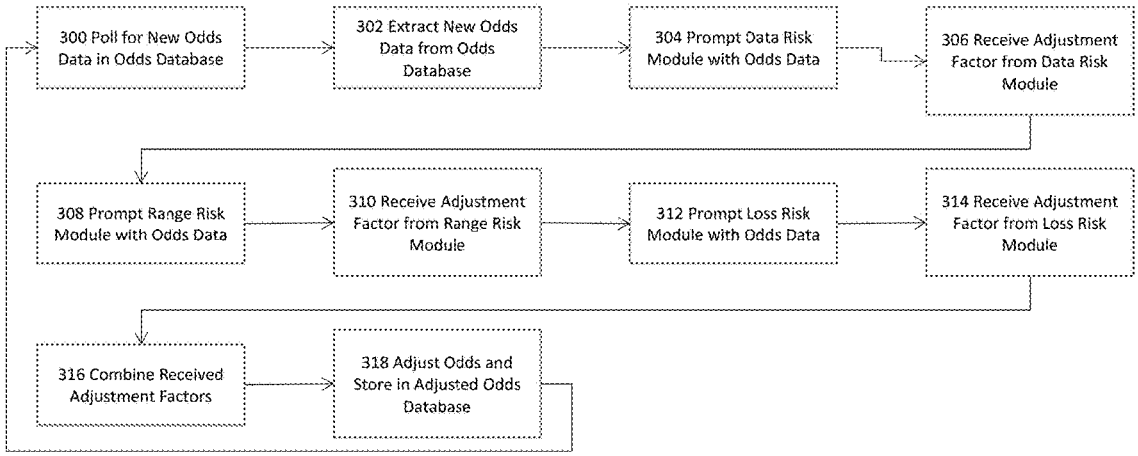
Fig.3 primary risk module Object Content
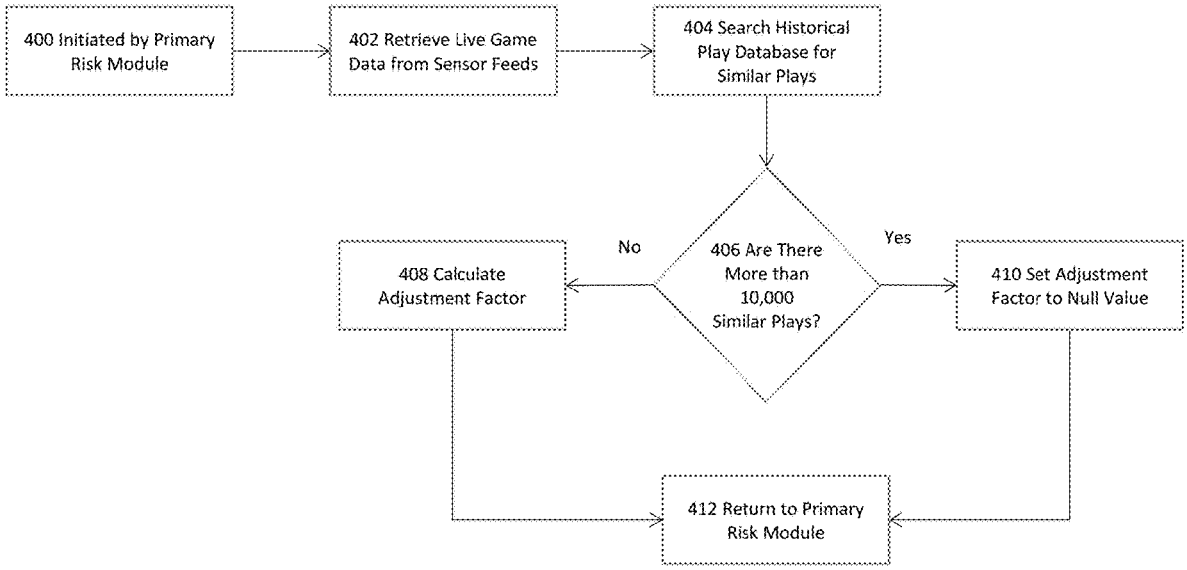
Fig.4 data risk module Object Content

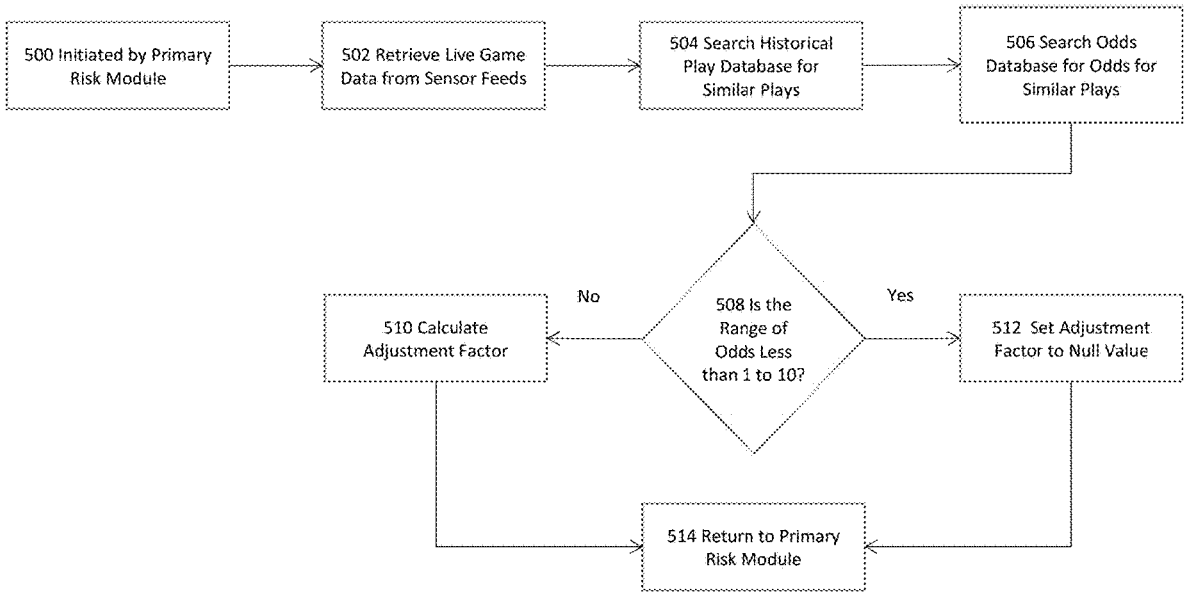
Fig.5 range risk module Object Content
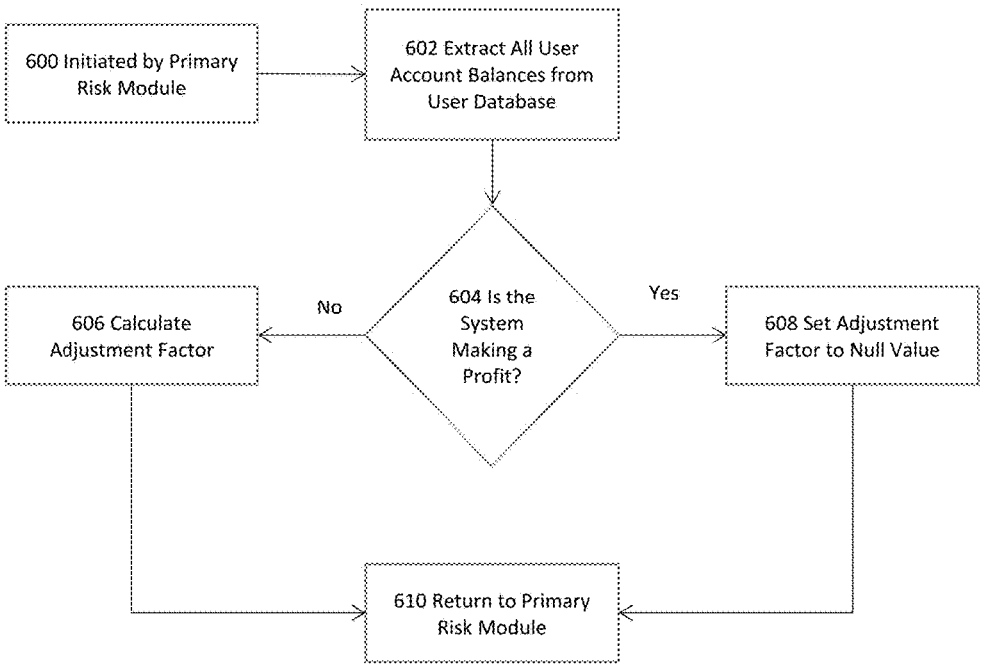
Fig.6 loss risk module Object Content

METHOD OF DETERMINING IF A SINGLE PLAY BET IS TOO RISKY

CROSS-REFERENCE TO RELATED APPLICATIONS

The present patent application claims benefit and priority to U.S. Provisional Patent Application No. 63/109,975 entitled "METHOD OF DETERMINING IF A SINGLE PLAY BET IS TOO RISKY" filed on Nov. 5, 2020 which is hereby incorporated by reference into the present disclosure.

FIELD

The embodiments are generally related to play by play wagering on live sporting events.

BACKGROUND

Current sports betting platforms provide numerous different ways to wager on entire sporting events, or individual aspects or portions of those events. One problem that arises with placing bets during a live event is that odds calculation must be done in real time. This often leads to issues wherein certain risks to the wager offeror are not accounted for.

These risks may arise from a lack of data to calculate odds accurately or a widely varying set of odds for similar scenarios. Further odds calculation based on historically measurable criteria such as weather data, player data, game data, etc. does not account for the immediate losses that the wager offeror may be suffering currently, but not historically.

BRIEF DESCRIPTIONS OF THE DRAWINGS

The accompanying drawings illustrate various embodiments of systems, methods, and various other aspects of the embodiments. Any person with ordinary skills in the art will appreciate that the illustrated element boundaries (e.g. boxes, groups of boxes, or other shapes) in the figures represent an example of the boundaries. It may be understood that, in some examples, one element may be designed as multiple elements or that multiple elements may be designed as one element. In some examples, an element shown as an internal component of one element may be implemented as an external component in another, and vice versa. Furthermore, elements may not be drawn to scale. Non-limiting and non-exhaustive descriptions are described with reference to the following drawings. The components in the figures are not necessarily to scale, emphasis instead being placed upon illustrating principles.

FIG. 1 illustrates a player focused wagering system, according to an embodiment.

FIG. 2 illustrates a risk adjusted odds database, according to an embodiment.

FIG. 3 illustrates a primary risk module, according to an embodiment.

FIG. 4 illustrates a data risk module, according to an embodiment.

FIG. 5 illustrates a range risk module, according to an embodiment.

FIG. 6 illustrates a loss risk module, according to an embodiment.

DETAILED DESCRIPTION

Aspects of the present invention are disclosed in the following description and related figures directed to specific embodiments of the invention. Those of ordinary skill in the art will recognize that alternate embodiments may be devised without departing from the spirit or the scope of the claims. Additionally, well-known elements of exemplary embodiments of the invention will not be described in detail or will be omitted so as not to obscure the relevant details of the invention.

As used herein, the word exemplary means serving as an example, instance or illustration. The embodiments described herein are not limiting, but rather are exemplary only. It should be understood that the described embodiments are not necessarily to be construed as preferred or advantageous over other embodiments. Moreover, the terms embodiments of the invention, embodiments or invention do not require that all embodiments of the invention include the discussed feature, advantage, or mode of operation.

Further, many of the embodiments described herein are described in terms of sequences of actions to be performed by, for example, elements of a computing device. It should be recognized by those skilled in the art that the various sequence of actions described herein can be performed by specific circuits (e.g., application specific integrated circuits (ASICs)) and/or by program instructions executed by at least one processor. Additionally, the sequence of actions described herein can be embodied entirely within any form of computer-readable storage medium such that execution of the sequence of actions enables the processor to perform the functionality described herein. Thus, the various aspects of the present invention may be embodied in a number of different forms, all of which have been contemplated to be within the scope of the claimed subject matter. In addition, for each of the embodiments described herein, the corresponding form of any such embodiments may be described herein as, for example, a computer configured to perform the described action.

With respect to the embodiments, a summary of terminology used herein is provided.

An action refers to a specific play or specific movement in a sporting event. For example, an action may determine which players were involved during a sporting event. In some embodiments, an action may be a throw, shot, pass, swing, kick, hit, performed by a participant in a sporting event. In some embodiments, an action may be a strategic decision made by a participant in the sporting event such as a player, coach, management, etc. In some embodiments, an action may be a penalty, foul, or type of infraction occurring in a sporting event. In some embodiments, an action may include the participants of the sporting event. In some embodiments, an action may include beginning events of sporting event, for example opening tips, coin flips, opening pitch, national anthem singers, etc. In some embodiments, a sporting event may be football, hockey, basketball, baseball, golf, tennis, soccer, cricket, rugby, MMA, boxing, swimming, skiing, snowboarding, horse racing, car racing, boat racing, cycling, wrestling, Olympic sport, eSports, etc. Actions can be integrated into the embodiments in a variety of manners.

A "bet" or "wager" is to risk something, usually a sum of money, against someone else's or an entity on the basis of the outcome of a future event, such as the results of a game or event. It may be understood that non-monetary items may be the subject of a "bet" or "wager" as well, such as points or anything else that can be quantified for a "bet" or "wager". A bettor refers to a person who bets or wagers. A bettor may also be referred to as a user, client, or participant throughout the present invention. A "bet" or "wager" could be made for obtaining or risking a coupon or some enhancements to the sporting event, such as better seats, VIP treatment, etc. A "bet" or "wager" can be done for certain amount or for a future time. A "bet" or "wager" can be done for being able to answer a question correctly. A "bet" or "wager" can be done within a certain period of time. A "bet" or "wager" can be integrated into the embodiments in a variety of manners.

A "book" or "sportsbook" refers to a physical establishment that accepts bets on the outcome of sporting events. A "book" or "sportsbook" system enables a human working with a computer to interact, according to set of both implicit and explicit rules, in an electronically powered domain for the purpose of placing bets on the outcome of sporting event. An added game refers to an event not part of the typical menu of wagering offerings, often posted as an accommodation to patrons. A "book" or "sportsbook" can be integrated into the embodiments in a variety of manners.

To "buy points" means a player pays an additional price (more money) to receive a half-point or more in the player's favor on a point spread game. Buying points means you can move a point spread, for example up to two points in your favor. "Buy points" can be integrated into the embodiments in a variety of manners.

The "price" refers to the odds or point spread of an event. To "take the price" means betting the underdog and receiving its advantage in the point spread. "Price" can be integrated into the embodiments in a variety of manners.

"No action" means a wager in which no money is lost or won, and the original bet amount is refunded. "No action" can be integrated into the embodiments in a variety of manners.

The "sides" are the two teams or individuals participating in an event: the underdog and the favorite. The term "favorite" refers to the team considered most likely to win an event or game. The "chalk" refers to a favorite, usually a heavy favorite. Bettors who like to bet big favorites are referred to "chalk eaters" (often a derogatory term). An event or game in which the sports book has reduced its betting limits, usually because of weather or the uncertain status of injured players is referred to as a "circled game." "Laying the points or price" means betting the favorite by giving up points. The term "dog" or "underdog" refers to the team perceived to be most likely to lose an event or game. A "longshot" also refers to a team perceived to be unlikely to win an event or game. "Sides", "favorite", "chalk", "circled game", "laying the points price", "dog" and "underdog" can be integrated into the embodiments in a variety of manners.

The "money line" refers to the odds expressed in terms of money. With money odds, whenever there is a minus (−) the player "lays" or is "laying" that amount to win (for example $100); where there is a plus (+) the player wins that amount for every $100 wagered. A "straight bet" refers to an individual wager on a game or event that will be determined by a point spread or money line. The term "straight-up" means winning the game without any regard to the "point spread"; a "money-line" bet. "Money line", "straight bet", "straight-up" can be integrated into the embodiments in a variety of manners.

The "line" refers to the current odds or point spread on a particular event or game. The "point spread" refers to the margin of points in which the favored team must win an event by to "cover the spread." To "cover" means winning by more than the "point spread". A handicap of the "point spread" value is given to the favorite team so bettors can choose sides at equal odds. "Cover the spread" means that a favorite win an event with the handicap considered or the underdog wins with additional points. To "push" refers to when the event or game ends with no winner or loser for wagering purposes, a tie for wagering purposes. A "tie" is a wager in which no money is lost or won because the teams' scores were equal to the number of points in the given "point spread". The "opening line" means the earliest line posted for a particular sporting event or game. The term "pick" or "pick 'em" refers to a game when neither team is favored in an event or game. "Line", "cover the spread", "cover", "tie", "pick" and "pick-em" can be integrated into the embodiments in a variety of manners.

To "middle" means to win both sides of a game; wagering on the "underdog" at one point spread and the favorite at a different point spread and winning both sides. For example, if the player bets the underdog+4½ and the favorite −3½ and the favorite wins by 4, the player has middled the book and won both bets. "Middle" can be integrated into the embodiments in a variety of manners.

Digital gaming refers to any type of electronic environment that can be controlled or manipulated by a human user for entertainment purposes. A system that enables a human and a computer to interact according to set of both implicit and explicit rules, in an electronically powered domain for the purpose of recreation or instruction. "eSports" refers to a form of sports competition using video games, or a multiplayer video game played competitively for spectators, typically by professional gamers. Digital gaming and "eSports" can be integrated into the embodiments in a variety of manners.

The term event refers to a form of play, sport, contest, or game, especially one played according to rules and decided by skill, strength, or luck. In some embodiments, an event may be football, hockey, basketball, baseball, golf, tennis, soccer, cricket, rugby, MMA, boxing, swimming, skiing, snowboarding, horse racing, car racing, boat racing, cycling, wrestling, Olympic sport, etc. Event can be integrated into the embodiments in a variety of manners.

The "total" is the combined number of runs, points or goals scored by both teams during the game, including overtime. The "over" refers to a sports bet in which the player wagers that the combined point total of two teams will be more than a specified total. The "under" refers to bets that the total points scored by two teams will be less than a certain figure. "Total", "over", and "under" can be integrated into the embodiments in a variety of manners.

A "parlay" is a single bet that links together two or more wagers; to win the bet, the player must win all the wagers in the "parlay". If the player loses one wager, the player loses the entire bet. However, if he wins all the wagers in the "parlay", the player wins a higher payoff than if the player had placed the bets separately. A "round robin" is a series of parlays. A "teaser" is a type of parlay in which the point spread, or total of each individual play is adjusted. The price of moving the point spread (teasing) is lower payoff odds on winning wagers. "Parlay", "round robin", "teaser" can be integrated into the embodiments in a variety of manners.

A "prop bet" or "proposition bet" means a bet that focuses on the outcome of events within a given game. Props are often offered on marquee games of great interest. These include Sunday and Monday night pro football games, various high-profile college football games, major college bowl games and playoff and championship games. An example of a prop bet is "Which team will score the first touchdown?" "Prop bet" or "proposition bet" can be integrated into the embodiments in a variety of manners.

A "first-half bet" refers to a bet placed on the score in the first half of the event only and only considers the first half of the game or event. The process in which you go about placing this bet is the same process that you would use to place a full game bet, but as previously mentioned, only the first half is important to a first-half bet type of wager. A "half-time bet" refers to a bet placed on scoring in the second half of a game or event only. "First-half-bet" and "half-time-bet" can be integrated into the embodiments in a variety of manners.

A "futures bet" or "future" refers to the odds that are posted well in advance on the winner of major events, typical future bets are the Pro Football Championship, Collegiate Football Championship, the Pro Basketball Championship, the Collegiate Basketball Championship, and the Pro Baseball Championship. "Futures bet" or "future" can be integrated into the embodiments in a variety of manners.

The "listed pitchers" is specific to a baseball bet placed only if both of the pitchers scheduled to start a game actually start. If they don't, the bet is deemed "no action" and refunded. The "run line" in baseball, refers to a spread used instead of the money line. "Listed pitchers" and "no action" and "run line" can be integrated into the embodiments in a variety of manners.

The term "handle" refers to the total amount of bets taken. The term "hold" refers to the percentage the house wins. The term "juice" refers to the bookmaker's commission, most commonly the 11 to 10 bettors lay on straight point spread wagers: also known as "vigorish" or "vig". The "limit" refers to the maximum amount accepted by the house before the odds and/or point spread are changed. "Off the board" refers to a game in which no bets are being accepted. "Handle", "juice", vigorish", "vig" and "off the board" can be integrated into the embodiments in a variety of manners.

"Casinos" are a public room or building where gambling games are played. "Racino" is a building complex or grounds having a racetrack and gambling facilities for playing slot machines, blackjack, roulette, etc. "Casino" and "Racino" can be integrated into the embodiments in a variety of manners.

Customers are companies, organizations or individual that would deploy, for fees, and may be part of, or perform, various system elements or method steps in the embodiments.

Managed service user interface service is a service that can help customers (1) manage third parties, (2) develop the web, (3) do data analytics, (4) connect thru application program interfaces and (4) track and report on player behaviors. A managed service user interface can be integrated into the embodiments in a variety of manners.

Managed service risk management services are services that assists customers with (1) very important person management, (2) business intelligence, and (3) reporting. These managed service risk management services can be integrated into the embodiments in a variety of manners.

Managed service compliance service is a service that helps customers manage (1) integrity monitoring, (2) play safety, (3) responsible gambling and (4) customer service assistance. These managed service compliance services can be integrated into the embodiments in a variety of manners.

Managed service pricing and trading service is a service that helps customers with (1) official data feeds, (2) data visualization and (3) land based, on property digital signage. These managed service pricing and trading services can be integrated into the embodiments in a variety of manners.

Managed service and technology platform are services that helps customers with (1) web hosting, (2) IT support and (3) player account platform support. These managed service and technology platform services can be integrated into the embodiments in a variety of manners.

Managed service and marketing support services are services that help customers (1) acquire and retain clients and users, (2) provide for bonusing options and (3) develop press release content generation. These managed service and marketing support services can be integrated into the embodiments in a variety of manners.

Payment processing services are those services that help customers that allow for (1) account auditing and (2) withdrawal processing to meet standards for speed and accuracy. Further, these services can provide for integration of global and local payment methods. These payment processing services can be integrated into the embodiments in a variety of manners.

Engaging promotions allow customers to treat your players to free bets, odds boosts, enhanced access and flexible cashback to boost lifetime value. Engaging promotions can be integrated into the embodiments in a variety of manners.

"Cash out" or "pay out" or "payout" allow customers to make available, on singles bets or accumulated bets with a partial cash out where each operator can control payouts by managing commission and availability at all times. The "cash out" or "pay out" or "payout" can be integrated into the embodiments in a variety of manners, including both monetary and non-monetary payouts, such as points, prizes, promotional or discount codes, and the like.

"Customized betting" allow customers to have tailored personalized betting experiences with sophisticated tracking and analysis of players' behavior. "Customized betting" can be integrated into the embodiments in a variety of manners.

Kiosks are devices that offer interactions with customers clients and users with a wide range of modular solutions for both retail and online sports gaming. Kiosks can be integrated into the embodiments in a variety of manners.

Business Applications are an integrated suite of tools for customers to manage the everyday activities that drive sales, profit, and growth, by creating and delivering actionable insights on performance to help customers to manage the sports gaming. Business Applications can be integrated into the embodiments in a variety of manners.

State based integration allows for a given sports gambling game to be modified by states in the United States or other countries, based upon the state the player is in, based upon mobile phone or other geolocation identification means. State based integration can be integrated into the embodiments in a variety of manners.

Game Configurator allow for configuration of customer operators to have the opportunity to apply various chosen or newly created business rules on the game as well as to parametrize risk management. Game configurator can be integrated into the embodiments in a variety of manners.

"Fantasy sports connector" are software connectors between method steps or system elements in the embodiments that can integrate fantasy sports. Fantasy sports allow a competition in which participants select imaginary teams from among the players in a league and score points according to the actual performance of their players. For example, if a player in a fantasy sports is playing at a given real time sports, odds could be changed in the real time sports for that player.

Software as a service (or SaaS) is a method of software delivery and licensing in which software is accessed online via a subscription, rather than bought and installed on individual computers. Software as a service can be integrated into the embodiments in a variety of manners.

Synchronization of screens means synchronizing bets and results between devices, such as TV and mobile, PC and wearables. Synchronization of screens can be integrated into the embodiments in a variety of manners.

Automatic content recognition (ACR) is an identification technology to recognize content played on a media device or present in a media file. Devices containing ACR support enable users to quickly obtain additional information about the content they see without any user-based input or search efforts. To start the recognition, a short media clip (audio, video, or both) is selected. This clip could be selected from within a media file or recorded by a device. Through algorithms such as fingerprinting, information from the actual perceptual content is taken and compared to a database of reference fingerprints, each reference fingerprint corresponding to a known recorded work. A database may contain metadata about the work and associated information, including complementary media. If the fingerprint of the media clip is matched, the identification software returns the corresponding metadata to the client application. For example, during an in-play sports game a "fumble" could be recognized and at the time stamp of the event, metadata such as "fumble" could be displayed. Automatic content recognition (ACR) can be integrated into the embodiments in a variety of manners.

Joining social media means connecting an in-play sports game bet or result to a social media connection, such as a FACEBOOK® chat interaction. Joining social media can be integrated into the embodiments in a variety of manners.

Augmented reality means a technology that superimposes a computer-generated image on a user's view of the real world, thus providing a composite view. In an example of this invention, a real time view of the game can be seen and a "bet" which is a computer-generated data point is placed above the player that is bet on. Augmented reality can be integrated into the embodiments in a variety of manners.

Some embodiments of this disclosure, illustrating all its features, will now be discussed in detail. It can be understood that the embodiments are intended to be open ended in that an item or items used in the embodiments is not meant to be an exhaustive listing of such item or items, or meant to be limited to only the listed item or items.

It can be noted that as used herein and in the appended claims, the singular forms "a," "an," and "the" include plural references unless the context clearly dictates otherwise. Although any systems and methods similar or equivalent to those described herein can be used in the practice or testing of embodiments, only some exemplary systems and methods are now described.

FIG. 1 is a system for a player focused wagering system. This system may include a live event 102, for example a sporting event such as a football game, basketball game, baseball game, hockey game, tennis match, golf tournament, eSports or digital game, etc. The live event 102 will include some number of actions or plays, upon which a user or bettor or customer can place a bet or wager, typically through an entity called a sportsbook. There are numerous types of wagers the bettor can make, including, a straight bet, a money line bet, a bet with a point spread or line that bettor's team would need to cover, if the result of the game with the same as the point spread the user would not cover the spread, but instead the tie is called a push. If the user is betting on the favorite, they are giving points to the opposing side, which is the underdog or longshot. Betting on all favorites is referred to as chalk, this is typically applied to round robin, or other styles of tournaments. There are other types of wagers, including parlays, teasers and prop bets, that are added games, that often allow the user to customize their betting, by changing the odds and payouts they receive on a wager. Certain sportsbooks will allow the bettor to buy points, to move the point spread off of the opening line, this will increase the price of the bet, sometimes by increasing the juice, vig, or hold that the sportsbook takes. Another type of wager the bettor can make is an over/under, in which the user bets over or under a total for the live event 102, such as the score of American football or the run line in baseball, or a series of action in the live event 102. Sportsbooks have a number of bets they can handle, a limit of wagers they can take on either side of a bet before they will move the line or odds off of the opening line. Additionally, there are circumstance, such as an injury to an important player such as a listed pitcher, in which a sportsbook, casino or racino will take an available wager off the board. As the line moves there becomes an opportunity for a bettor to bet on both sides at different point spreads in order to middle and win both bets. Sportsbooks will often offer bets on portions of games, such as first half bets and half time bets. Additionally, the sportsbook can offer futures bets on live events 102 in the future. Sportsbooks need to offer payment processing services in order to cash out customers. This can be done at kiosks at the live event 102 or at another location.

Further, embodiments may include a plurality of sensors 104 that may be used such as motion sensors, temperature sensors, humidity sensors, cameras such as an RGB-D camera which is a digital camera capable of capturing color (RGB) and depth information for every pixel in an image, microphones, a radiofrequency receiver, a thermal imager, a radar device, a lidar device, an ultrasound device, a speaker, wearable devices etc. Also, the plurality of sensors 104 may include tracking devices, such as RFID tags, GPS chips or other such devices embedded on uniforms, in equipment, in the field of play, in the boundaries of the field of play, or other markers on the field of play. Imaging devices may also be used as tracking devices such as player tracking that provides statistical information through real-time X, Y positioning of players and X, Y, Z positioning of the ball.

Further, embodiments may include a cloud 106 or communication network that may be a wired and/or a wireless network. The communication network, if wireless, may be implemented using communication techniques such as Visible Light Communication (VLC), Worldwide Interoperability for Microwave Access (WiMAX), Long Term Evolution (LTE), Wireless Local Area Network (WLAN), Infrared (IR) communication, Public Switched Telephone Network (PSTN), Radio waves, and other communication techniques known in the art. The communication network may allow ubiquitous access to shared pools of configurable system resources and higher-level services that can be rapidly provisioned with minimal management effort, which may occur over the Internet and relies on sharing of resources to achieve coherence and economies of scale, like a public utility, while third-party clouds allow organizations to focus on their core businesses instead of expending resources on computer infrastructure and maintenance. The cloud 106 may be communicatively coupled to a wagering network 108 which may perform real time analysis on the type of play and the result of the play. The cloud 106 may also be synchronized with game situational data, such as the time of the game, the score, location on the field, weather conditions, and the like which may affect the choice of play utilized. For example, in an exemplary embodiment, the cloud 106 may not receive data gathered from the plurality of sensors 104 and may, instead, receive data from an alternative data feed, such as Sports Radar®. This data may be compiled substantially immediately following the completion of any play and the data from this feed may be compared with a variety of team data and league data based on a variety of elements, including down, possession, score, time, team, and so forth, as described in various exemplary embodiments herein.

Further, embodiments may include the wagering network 108 which may perform real time analysis on the type of play and the result of a play or action. The wagering network 108 (or cloud 106) may also be synchronized with game situational data, such as the time of the game, the score, location on the field, weather conditions, and the like which may affect the choice of play utilized. For example, in an exemplary embodiment, the wagering network 108 may not receive data gathered from the plurality of sensors 104 and may, instead, receive data from an alternative data feed, such as Sports Radar®. This data may be provided substantially immediately following the completion of any play and the data from this feed may be compared with a variety of team data and league data based on a variety of elements, including down, possession, score, time, team, and so forth, as described in various exemplary embodiments herein. The wagering network 108 may offer any number of software as a service managed services such as, user interface service, risk management service, compliance, pricing and trading service, IT support of the technology platform, business applications, game configuration, state based integration, fantasy sports connection, integration to allow the joining of social media, and marketing support services that can deliver engaging promotions to the user.

Further, embodiments may include a user database 110 which contains data relevant to all users of the system, and may include any of, a user ID of the user, a device identifier for their mobile device 128, a list of the players indicated as favorites by the user, and could also include wagering history on the user, and other relevant user data. Further, embodiments may include an odds calculation module 112 which utilizes historical play data to calculate odds for in-play wagers.

Further, embodiments may include a historical plays database 114, that contains play data for the type of sport being played in live event 102. For example, in American football for optimal odds calculation, the historical play data may include meta data about the historical plays, such as time, location, weather, previous plays, opponent, physiological data, etc.

Further, embodiments may include an odds database 116 that contains the odds calculated by the odds calculation module to display the odds to the user's mobile device 128 and to take bets from the user through a mobile device wagering app 130.

Further, embodiments may include a risk adjusted odds database 118 which stores the original odds from odds database 116 as well as the risk adjusted odds. The database may store any of plays, the players of plays, odds given, and a time stamp for when the odds have been risk adjusted.

Further, embodiments may include a primary risk module 120 which coordinates any of related specific risk modules. By coordination, this module will determine play by play which specific risk modules to use. This is accomplished by each specific risk module analyzing the current play and returning a risk adjustment to the odds. If several specific risk modules return odds adjustment, this primary risk module 120 would determine final risk, by any of a number of means, for instance it could (1) select the lowest risk returned, (2) calculate and then use the mean of the adjusted risk scores, etc. If more than one risk is returned, the primary risk module 120 would determine the range of risks and may, for example, create the average of the risk and use this average to determine if the odds needs to be adjusted. The primary risk module 120 could use the highest risk of multiple risks and this highest risk would be used to determine if the odds needs to be adjusted. The primary risk module 120 also allows for executing specific risk modules that can be executed in various places on the cloud, such as but not limited to (1) an integrated module in the wager network, (2) a 3rd party module that is called by the wager network 108, (3) a plurality of 3rd party modules where multiple risks can be evaluated, a (4) hybrid of integrated module and 3rd part modules. Of course, it is understood, if the specific risk modules is not on the wagering network 108 itself, adequate data from the wagering network 108 would be made available (thru API's) to the specific risk modules not on the wager network.

Further, embodiments may include a data risk module 122 which first checks the weather this module is needed. This is done by looking at the bet on a play and determining how many times this bet has been played at the current odds. If there is a significant amount of data in the data base, say >10,000 bets, this module returns "no change to the odds" however, this module may find, for instance, that if f odds are calculated for <10,000 bets but say >5,000 bets, there is more risk associated with the bet, so the odds are changed and may move form 2:1 to 3:1. If for instance there is even far less data that was used, say <5,000 bets to >1000 bets, there is even more risk associated with the bet, so the odds are changed and may move say 2:1 to 5:1. If there are less than 1000 bets, a "lock" is returned in than a bet is not offered. The actual number of datapoints ranges and odds adjustment can be predefined or this could be calculated in real time. They can be predefined by evaluating historical data of related bets and data points and ranges of adjustment of bets. They can be calculated in real time by changing the risk adjustment up or down based upon data points and the results can then be used to continue to look at data point ranges and adjustments to get closer to having odds that benefit the profit of the system.

Further, embodiments may include a range risk module 124 which first checks whether this module is needed. This is done by looking at the bet on a play and determining how the range of bets of the play, for example 2:1 to 2.5:1 or 2:1 to 10:1. If there is a significant amount of range in the data base, say <0.5:1 odds change, this module returns "no change to the odds". However, this module may find, for instance, that if the odds are calculated for 2:1 to 5:1, there is more risk associated with the bet, so the odds are changed and may move to, for instance 3.5:1 (which is the midpoint of 2:1 and 5:1). If for instance there is even far great odds changes found, for instance 2:1 to 10:1 range, there is even more risk associated with the bet, so the odds are changed and may move say 2:1 to 6:1 which is above the midpoint. If there are large ranges, say 2:1 to >10:1 in odds, a "lock" is returned so that a bet is not offered. The actual ranges and odds adjustment can be predefined, or they could be calculated in real time. They can be predefined by evaluating historical data of related bets and ranges of bets. They can be calculated in real time by slowly changing the risk adjustment up or down based upon ranges of odds of a bet and then using the results to continue to look at data point ranges and adjustments to get closer to having odds that benefit the profit of the system.

Further, embodiments may include a loss risk module 126 which first checks whether this module is needed. This is done by looking at average wins and losses of all betters and determining the amount of loss per unit time of per amounts of bets is acceptable. For example, if the system is currently running a profit, this module will return a "no change in odds" If however, the system is currently losing $100,000 and the loss is increasing at $5,000 per play, this is an significant amount of loss in the data base, and so all odds will be adjusted to lower their risk, for example change the odds by 10% to lower risk. However, this module may find, for instance, that there is more significant loss, at $250,000 and the loss is increasing at $10,000 per play. This is a very significant amount of loss in the data base, and so all odds will be adjusted to lower their risk, for example change the odds by 30% to lower risk. If there is even more loss that system may send a "lock" to certain high odds bets in general. The actual losses and rates of loses can be predefined or they could be calculated in real time. They can be predefined by evaluating historical data of related bets and ranges of loses. They can be calculated in real time by slowly changing the risk adjustment up or down based upon loses and then results are used over to continue look at loses and adjustments are made to get closer to having odds that benefit the profit of the system.

Further, embodiments may include the mobile device 128 such as a computing device, laptop, smartphone, tablet, computer, smart speaker, or I/O devices. I/O devices may be present in the computing device. Input devices may include keyboards, mice, trackpads, trackballs, touchpads, touch mice, multi-touch touchpads and touch mice, microphones, multi-array microphones, drawing tablets, cameras, single-lens reflex camera (SLR), digital SLR (DSLR), CMOS sensors, accelerometers, infrared optical sensors, pressure sensors, magnetometer sensors, angular rate sensors, depth sensors, proximity sensors, ambient light sensors, gyroscopic sensors, or other sensors. Output devices may include video displays, graphical displays, speakers, headphones, inkjet printers, laser printers, and 3D printers. Devices may include a combination of multiple input or output devices, including, e.g., Microsoft KINECT, Nintendo Wii mote for the WIT, Nintendo WII U GAMEPAD, or Apple IPHONE. Some devices allow gesture recognition inputs through combining some of the inputs and outputs. Some devices allow for facial recognition which may be utilized as an input for different purposes including authentication and other commands. Some devices allows for voice recognition and inputs, including, e.g., Microsoft KINECT, SIRI for IPHONE by Apple, Google Now or Google Voice Search. Additional user devices have both input and output capabilities, including, e.g., haptic feedback devices, touchscreen displays, or multi-touch displays. Touchscreen, multi-touch displays, touchpads, touch mice, or other touch sensing devices may use different technologies to sense touch, including, e.g., capacitive, surface capacitive, projected capacitive touch (PCT), in-cell capacitive, resistive, infrared, waveguide, dispersive signal touch (DST), in-cell optical, surface acoustic wave (SAW), bending wave touch (BWT), or force-based sensing technologies. Some multi-touch devices may allow two or more contact points with the surface, allowing advanced functionality including, e.g., pinch, spread, rotate, scroll, or other gestures. Some touch-screen devices, including, e.g., Microsoft PIXELSENSE or Multi-Touch Collaboration Wall, may have larger surfaces, such as on a table-top or on a wall, and may also interact with other electronic devices. Some I/O devices, display devices or group of devices may be augmented reality devices. The I/O devices may be controlled by an I/O controller. The I/O controller may control one or more I/O devices, such as, e.g., a keyboard and a pointing device, e.g., a mouse or optical pen. Furthermore, an I/O device may also contain storage and/or an installation medium for the computing device. In still other embodiments, the computing device may include USB connections (not shown) to receive handheld USB storage devices. In further embodiments, an I/O device may be a bridge between the system bus and an external communication bus, e.g. a USB bus, a SCSI bus, a FireWire bus, an Ethernet bus, a Gigabit Ethernet bus, a Fiber Channel bus, or a Thunderbolt bus. In some embodiments the mobile device 128 could be an optional component and would be utilized in a situation in which a paired wearable device is utilizing the mobile device 128 as additional memory or computing power or connection to the internet.

Further, embodiments may include the wagering app 130, which is a program that enables the user to place bets on individual plays in the live event 102, and display the audio and video from the live event 102, along with the available wagers on the mobile device 128. The wagering app 130 allows the user to interact with the wagering network 108 in order to place bets and provide payment/receive funds based on wager outcomes.

FIG. 2 illustrates the risk adjusted odds database 118. The risk adjusted odds database 118 contains the original odds from odds database 116 as well as the risk adjusted odds. The database contains a play ID, for example, 1, all players involved in the play, for example "Dak Prescott", "CeeDee Lamb" "Ezekiel Elliot", etc. and, a time stamp for when the odds have been risked adjusted, for example, 8:43:22 PM 10/27/2020. In some embodiments the database may contain additional data on the conditions of the play such as weather, game time, teams, etc.

FIG. 3 illustrates the primary risk module 120. The process begins with the primary risk module 120 polling, at step 300, for new odds data in the odds database 116. The primary risk module 120 extracts, at step 302, the new odds data in the odds database 116; in some embodiments the primary risk module may also obtain data from the sensor feeds 104. The primary risk module 120 prompts, at step 304, the data risk module 122 with the extracted odds data. The primary risk module 120 receives, at step 306, an adjustment factor from the data risk module 122. In this example the adjustment factor is in the form of a percentage to adjust the odds down so as to lessen the risk to the wagering network 108. This percentage adjustment is larger the more uncertainty there is about the outcome, as calculated by the data risk module 122, the range risk module 124, and the loss risk module 126. The primary risk module 120 prompts, at step 308, the range risk module 124 with the extracted odds data. The primary risk module 120 receives, at step 310, an adjustment factor from the range risk module 124. The primary risk module 120 prompts, at step 312, the loss risk module 126 with the extracted odds data. The primary risk module 120 receives, at step 314, an adjustment factor from the data risk module 126. The primary risk module 120 combines, at step 316, the received adjustment factors by averaging the factors. In some embodiments the factors may be combined by other methods such as selecting the smallest factor, selecting the largest factor, multiplying the factors together, etc. The primary risk module 120 adjusts, at step 318, the odds based on the combined adjustment factor, for example if the odds from the odds calculation module 112 were originally 1 to 2 and the combined risk adjustment factor is 0.9 then the odds will be adjusted by multiplying the payout by 0.9, yielding odds of 1 to 1.8, the adjusted odds are then stored in the risk adjusted odds database 118 and the primary risk module 120 returns to polling for new odds data in the odds database 116. It should be obvious that these risk factors are not the only risk factors that could be considered, and that they could be used individually or in different combinations. The different risk factors could be weighted differently, and all of these variables could change based on the context of the live event 102 and/or the wagering activity on the wagering network 108.

FIG. 4 illustrates the data risk module 122. The process begins with the data risk module 122 being, at step 400, initiated by the primary risk module 120. The data risk module 122 retrieves, at step 402, data on the current state of the live event 102 from the sensor feed of the plurality of sensors 104; for example the live event 102 features the Dallas Cowboys against the Cleveland Browns, Dallas is on offence, it is 2nd and 7 yards and 3 minutes into the second quarter, and the weather is sunny with 5 mph winds. The data risk module 122 searches, at step 404, the historical play database 114 for plays that are similar to the current state of the live event 102, similar does not mean exact, some parameters may be within a range of values and not all parameters must be similar for a play to be similar, for example the live event 102 features the Dallas Cowboys against the Cleveland Browns, Dallas is on offence, its is 2nd and 7 yards and 3 minutes into the second quarter, and the weather is sunny with 5 mph winds, a similar play may be one wherein the Dallas Cowboys played against the Cleveland Browns, Dallas was on offence, it was 2nd and 5 yards and 6 minutes into the second quarter, and the weather was sunny with no wind. In some embodiments the criteria for a similar play may be dynamic. The data risk module 122 determines, at step 406, if there are more than 10,000 similar plays stored in the historical play database 114, in other embodiments the number may be a different number than 10,000, in some embodiments this number may be set dynamically. If there are less than 10,000 similar plays, the data risk module 122 calculates, at step 408, an adjustment factor based on the amount of results, if the results are between 10,000 and 5,000 the factor is 0.9, if the number is less than 5,000 the factor is 0.8. For example, the live event 102 features the Dallas Cowboys against the Cleveland Browns, Dallas is on offence, it is 2nd and 7 yards and 3 minutes into the second quarter, and the weather is sunny with 5 mph winds, there are 4000 plays in the historical play database 114 which are similar to the current play of the live event 102, since 4000 is less than 5000 the adjustment factor for wagers made on the current play is 0.8. In other embodiments the adjustment factor may be calculated by other methods, for example, multiplying the number of results by 0.0001. It should be obvious that these thresholds could be based on other factors besides the number of bets placed on similar plays in the past; for example, the amount of money wagered on a similar play in the past, or the winning percentage of users on similar plays in the past. Additionally, how the system identifies a similar play could be done based on characteristics of the live event 102, such as the down and distance, team, weather, etc., as it is in this embodiment, but it could also be done based on the nature of the wagers placed on that play or characteristics of the users who have placed bets on the play. If there are more than 10,000 similar plays, the data risk module 122 sets, at step 410, the adjustment factor to a null value, in some embodiments this may be achieved by simply setting the adjustment factor to 1. The data risk module 122 returns, at step 412, to the primary risk module 120 with the adjustment factor.

FIG. 5 illustrates the range risk module 124. The process begins with the range risk module 124 being, at step 500, initiated by the primary risk module 120. The range risk module 124 retrieves, at step 502, data on the current state of the live event 102 from the sensor feed of the plurality of sensors 104, for example the live event 102 features the Dallas Cowboys against the Cleveland Browns, Dallas is on offence, it is 2nd and 7 yards and 3 minutes into the second quarter, and the weather is sunny with 5 mph winds. The range risk module 124 searches, at step 504, the historical play database 114 for plays that are similar to the current state of the live event 102, similar does not mean exact, some parameters may be within a range of values and not all parameters must be similar for a play to be similar, for example the live event 102 features the Dallas Cowboys against the Cleveland Browns, Dallas is on offence, it is 2nd and 7 yards and 3 minutes into the second quarter, and the weather is sunny with 5 mph winds, a similar play may be one wherein the Dallas Cowboys played against the Cleveland Browns, Dallas was on offence, it was 2nd and 5 yards and 6 minutes into the second quarter, and the weather was sunny with no wind. In some embodiments the criteria for a similar play may be dynamic. The range risk module 124 searches, at step 506, the odds database 116 for the corresponding odds to each of the similar plays found in the historical play database 114. The range risk module 124 determines, at step 508, if the range of odds for all of the similar plays is less than 1 to 10, for example if the lowest odds for a similar play is 1 to 1 and the highest is 1 to 9 then the range is 1 to 8, this can be expressed more clearly in percentages, 1 to 1 is a 100% return on wager 1 to 9 is a 900% return on wager and therefore the range is 800% return on wager and less than 1 to 10 or 1000%. If the lowest odds for a similar play is 2 to 1 and the highest is 1 to 12 then the range would be greater than 1 to 10. If the range of odds for all of the similar plays is more than 1 to 10, the range risk module 124 calculates, at step 510, an adjustment factor based on the range of odds, if the range of odds are between 1 to 10 and 1 to 15 the factor is 0.9, if the range of odds is more than 1 to 15 the factor is 0.8. For example, the live event 102 features the Dallas Cowboys against the Cleveland Browns, Dallas is on offence, it is 2nd and 7 yards and 3 minutes into the second quarter, and the weather is sunny with 5 mph winds, there are 10,000 plays in the historical play database 114 which are similar to the current play of the live event 102, each similar play has a number of wager options which each have their own individual odds, the lowest odds on one of the similar plays is 2 to 1 and the highest odds on another one of the similar plays is 1 to 20, since the range of odds is more than 1 to 15 the adjustment factor for wagers on the current play is 0.8. It should be obvious that these thresholds could be based on other factors besides the odds of bets placed on similar plays in the past; for example, the amount of money wagered on a similar play in the past, or the winning percentage of users on similar plays in the past. Additionally, how the system identifies a similar play could be done based on characteristics of the live event 102, such as the down and distance, team, weather, etc., as it is in this embodiment, but it could also be done based on the nature of the wagers placed on that play or characteristics of the users who have placed bets on the play. In other embodiments the adjustment factor may be calculated by other methods, for example, dividing 10 by the range of odds expressed as a whole number, for example, if the range of odds is 1 to 20, then the factor would be 10/20 or 0.5. If the range of odds for all of the similar plays is less than 1 to 10, the range risk module 124 sets, at step 512, the adjustment factor to a null value, in some embodiments this may be achieved by simply setting the adjustment factor to 1. The range risk module 124 returns, at step 514, to the primary risk module 120 with the adjustment factor.

FIG. 6 illustrates the loss risk module 126. The process begins with the loss risk module 126 being, at step 600, initiated by the primary risk module 120. The loss risk module 126 searches, at step 602, the user database 110 for all user account balances, in some embodiments the loss risk module 126 will only search for changes to account balances within a set time frame for example, the last day, since the start of the current live event 102, the last 10 plays, etc. In other embodiments the loss risk module 126 may retrieve the total net losses or gains of the system from another source or database. The loss risk module 126 determines, at step 604, if the system is making a profit by determining the net gain across all user account balances, if the net gain is positive then the system is losing money, if the net gain is negative then the system is gaining money and therefore making a profit. In some embodiments the loss risk module 126 may consider costs from other sources such as employee pay, maintenance costs of the system, credit given freely to users, royalties, etc. If the system is not profitable, the loss risk module 126 calculates, at step 606, an adjustment factor based on the total amount of loss, if the net loss less than $5,000 the factor is 0.9, if the net loss is more than 5,000 the factor is 0.8. For example, the live event 102 features the Dallas Cowboys against the Cleveland Browns, Dallas is on offence, it is 2nd and 7 yards and 3 minutes into the second quarter, and the weather is sunny with 5 mph winds, since the beginning of the live event 102 the system has lost a net $3,000, since $3,000 is less than $5,000 the adjustment factor for wagers made on the current play is 0.9. It should be obvious that these thresholds could be based on other factors besides total net loss. For example, the amount of difference between actual and expected revenue or the net change in profit from one play to the next. Additionally, how the system identifies a similar play could be done based on characteristics of the live event 102, such as the down and distance, team, weather, etc., as it is in this embodiment, but it could also be done based on the nature of the wagers placed on that play or characteristics of the users who have placed bets on the play. In some embodiments the adjustment factor may calculated based on the required amount of adjustment to turn the system profitable, for example if the net loss is 10% of the total money wagered then setting the adjustment factor to 0.9 or lower would be expected to turn the system profitable. If the system is profitable, the loss risk module 126 sets, at step 608, the adjustment factor to a null value, in some embodiments this may be achieved by simply setting the adjustment factor to 1. The loss risk module 126 returns, at step 610, to the primary risk module 120 with the adjustment factor.

What is claimed is:

1. A system for enhancing user experience of an in-play sports betting game, comprising:

data received from a live sporting event, wherein the system is configured to receive one or more wagers placed on plays inside the live sports event, a wagers database;

at least one offered wager with odds, said at least one offered wager associated with a single play of the live sports event;

a primary risk module, a risk adjusted odds database which stores adjusted odds, and a plurality of secondary risk modules including a range risk module configured to provide a determination of whether a variable range of odds has been provided on the at least one offered wager, wherein the primary risk module is configured to adjust the odds of the at least one wager based on an adjustment factor generated by at least one secondary risk module in the plurality of secondary risk modules, and wherein the primary risk module determines, from a predetermined plurality of module types, a type of the at least one secondary risk module based on context of the wager and the single play, the odds stored in the risk adjusted odds database, and the determination of the range risk module.

2. The system for enhancing user experience of an in-play sports betting game of claim 1, wherein the system is configured to determine the adjustment factor based on a comparison of data by the at least one secondary risk module and context of the single play.

3. The system for enhancing user experience of an in-play sports betting game of claim 2, wherein the primary risk module is further configured to perform processing comprising one of an odds adjustment or cancellation on the at least one offered wager if a number of wagers placed on the at least one offered wager meets a predetermined threshold value.

4. The system for enhancing user experience of an in-play sports betting game of claim 1, further comprising a data risk module configured to query the wagers database to determine how many wagers have been placed on the at least one offered wager.

5. The system for enhancing user experience of an in-play sports betting game of claim 1, further comprising a loss risk module configured to determine a success rate of wagers placed on one or more previously offered wagers and, if the success rate meets a predetermined threshold, adjusts the odds on the at least one offered wager.

6. A method for determining an output based on historical and contextual data of a single play in a live sporting event, comprising:

retrieving data regarding a single play in a live sporting event;

comparing context of the single play to data in a historical play database;

searching an odds database for single play wager odds similar to the single play in the live sporting event;

retrieving previously adjusted odds for plays with similar context from a risk adjusted odds database;

determining odds for a wager on the single play of the live sporting event;

adjusting the odds for the wager on the single play of the live sporting event based upon a threshold value being met and the previously adjusted odds from the risk adjusted odds database, wherein determination of whether the threshold value is met comprises at least one of: determining whether a number of historical plays in the historical play database is above at least one first predetermined value, determining whether a range of odds provided in the odds database is above at least one second predetermined value, and determining whether a sum of revenue records provided in the odds database is above at least one third predetermined value, determining an adjustment factor and adjusting the odds for the wager on the single play of the live sporting event based on a combination of two or more of a data risk module that queries the wagers database to determine how many wagers have been placed on the at least one offered wager, a range risk module that determines if a variable range of odds has been provided on the at least one offered wager, and a loss risk module that determines a success rate of wagers placed on one or more previously offered wagers and, if the success rate meets a predetermined threshold, adjusts the odds on the at least one offered wager.

* * * * *